United States Patent [19]

Sheath et al.

[11] Patent Number: 4,643,130

[45] Date of Patent: Feb. 17, 1987

[54] GRAVURE PRINTING MACHINE

[75] Inventors: Jeremy C. Sheath; William D. Hodges, both of London, England

[73] Assignee: Machines Chambon S.A., Orleans-Cedex, France

[21] Appl. No.: 576,508

[22] Filed: Feb. 2, 1984

[30] Foreign Application Priority Data

Feb. 4, 1983 [GB] United Kingdom ..... 8303174

[51] Int. Cl.[4] ..... B05C 1/02; B05C 11/00

[52] U.S. Cl. ..... 118/681; 118/39; 118/46; 118/212; 118/236

[58] Field of Search ..... 118/39, 46, 236, 212, 118/681; 427/288, 293; 101/153, 183, 152

[56] References Cited

U.S. PATENT DOCUMENTS

| | | | |
|---|---|---|---|
| 1,540,295 | 6/1925 | Swift | 427/288 X |
| 3,467,060 | 9/1969 | Klebanow et al. | 118/236 X |
| 3,548,747 | 12/1970 | D'Amato | 101/153 |
| 3,559,617 | 2/1971 | Seragnoli | 118/681 |
| 4,411,217 | 10/1983 | Valenti | 118/212 |
| 4,497,274 | 2/1985 | Focke | 118/212 X |

*Primary Examiner*—Evan K. Lawrence
*Attorney, Agent, or Firm*—Neil F. Markva

[57] ABSTRACT

Apparatus for forming matchbox skillets from pre-printed sheets, each sheet having a plurality of rows of matchbox blanks printed thereon. The apparatus includes a sheet feeder for storing pre-printed sheets and removing the sheets one-by-one. The sheets are fed to a gravure printing machine, which applies stripes of striking compound material to predetermined areas of the sheets as they pass therethrough. A conveyor is provided for conveying the sheets from the sheet feeder to the gravure printing machine. After leaving the gravure printing machine the stripes of striking compound material are dried in a radio frequency drier. The sheets are then cut into matchbox blanks by cutting machines. The gravure printing machine has an upper engraving roller, a lower pressure roller, and means for feeding the sheets between the two rollers so that the stripes are printed on the upper surface of the sheets in register with the matchbox blanks.

20 Claims, 7 Drawing Figures

GRAVURE PRINTING MACHINE

BACKGROUND TO THE INVENTION

This invention relates to a gravure printing machine, and in particular to a gravure printing machine for applying patterned striking compound stripes to pre-printed sheets to form finished matchbox skillets.

Conventionally, matchboxes are made by printing a plurality of rows of matchbox blanks on a continuous web of board, and then by applying stripes of striking compound to the blanks in a separate gravure printing operation. The gravure printing machine used in this process has the engraving roller positioned beneath the backing (or pressure) roller, so that the web is passed through the printing nip of the machine upside-down, that is to say with the pre-printed side facing down. After the web has left the gravure printing machine, the striking compound is dried in a radio frequency drier. As it is important that the striking compound does not touch any part of the drier, it is necessary to pass the web over a pair of reversing rollers prior to entering the drier, so that the printed surface of the web is uppermost when it enters the drier.

This conventional process is generally satisfactory, but it is only economical for long printing runs. For short printing runs, it would be much more economical to apply the stripes of striking compound to pre-printed sheets. Unfortunately, the known method would not be satisfactory for use with pre-printed sheets, as wet strips of striking compound would face downwards as the sheets leave the printing machine, and could not easily be turned over prior to entering the radio frequency drier.

The aim of the invention is to provide a gravure printing machine that can print stripes of striking compound material onto pre-printed sheets, and which can be used upstream of a radio frequency drier without having to re-orientate the sheets after they have left the printing machine.

SUMMARY OF THE INVENTION

The present invention provides a gravure printing machine for applying coating material to predetermined areas of pre-printed sheets, the machine comprising an upper engraving roller, a lower pressure roller, and means for feeding pre-printed sheets between the two rollers so that said predetermined areas are in register with complementary areas of the pre-printed sheets.

The use of such an "upside-down" gravure printing machine results in the sheets leaving the machine with the wet coating material on said predetermined areas facing upwards. Consequently, the sheets can then be passed to a radio frequency drier without there being any danger of such wet areas touching any part of the drier.

Advantageously, the machine further comprises means for supplying coating material to the surface of the engraving roller, means for distributing the coating material evenly over the surface of the engraving roller, and means for adjusting the nip between the two rollers. The supply means may be constituted by a pump and at least one nozzle, and the distribution means may be constituted by a doctor blade.

Where the machine is used to print striking panels onto sheets pre-printed with matchbox blanks, the surface of the engraving roller is advantageously formed with a plurality of rows of patterned areas, each of which corresponds in shape to that of the striking panel of a box of matches, there being as many rows as there are rows of pre-printed matchbox blanks on the sheets fed to the printing machine.

In a preferred embodiment, the pressure roller is partially covered by a blanket. Advantageously, the blanket passes around 300° of the circumference of the pressure roller, one surface of the blanket has a self-adhesive coating, and the blanket is about 1 millimeter thick.

Conveniently, the machine further comprises operator means for moving the rollers apart. Advantageously, the operator means is controlled by sensing means arranged to sense the sheets as they are fed towards the rollers. Preferably, the operator means is effective to move the pressure roller towards, and away from, the engraving roller.

In a preferred embodiment, the pressure roller is mounted on eccentric bearings, each of which is moved up and down by a respective arm, each of said arms being moved, in turn, by a half-revolution clutch which rotates a respective eccentric disc carrying a cam roller which engages in a slot formed in the end of the respective arm.

The invention also provides apparatus for forming matchbox skillets from pre-printed sheets, each sheet having a plurality of rows of matchbox blanks printed thereon, the apparatus comprising a sheet feeder for storing pre-printed sheets and removing the sheets one-by-one, a gravure printing machine for applying coating material to predetermined areas of the sheets as they pass therethrough, a conveyor for conveying the sheets from the sheet feeder to the gravure printing machine, and means for cutting up the sheets into matchbox skillets, wherein the gravure printing machine is as defined above.

Where the coating material is a striking compound material, the apparatus may further comprise a drier for drying the coating material printed on said predetermined areas, the drier being positioned downstream of the gravure printing machine. Preferably, the drier is a radio frequency drier.

Advantageously, first and second cutting stations constitute the means for cutting up the sheets, the first cutting station cutting the sheets longitudinally, and the second cutting station cutting the sheets transversely. Both cutting stations may be positioned downstream of the drier. Alternatively, the first cutting station is positioned upstream of the gravure printing machine, and the second cutting station is positioned downstream of the drier. In either case, the first cutting station may form part of a slitter/creaser unit, and includes means for forming transverse creases on the matchbox blanks.

The apparatus of the invention provides a method of making matchbox skillets from pre-printed sheets, each sheet having a plurality of rows of matchbox blanks printed thereon, the method comprising the steps of printing a stripe of striking compound material on a predetermined area of each of the blanks using a gravure printing machine, and cutting up the sheets to form matchbox skillets, wherein said stripes are printed on the upper surfaces of the sheets as they pass through the gravure printing machine. Preferably, the method further comprises the step of drying the stripes of striking compound material after the sheets have passed through the gravure printing machine.

BRIEF DESCRIPTION OF DRAWINGS

Two forms of apparatus for forming matchbox blanks from pre-printed sheets, and constructed in accordance with the invention, will now be described, by way of example, with reference to the accompanying drawings, in which.

DESCRIPTION OF PREFERRED EMBODIMENTS

Figure 1:
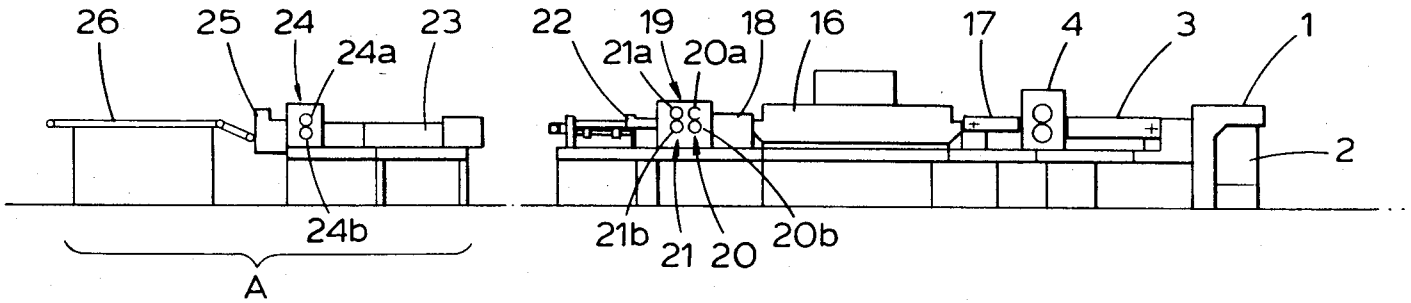
FIG. 1 is a schematic side elevation of the first form of apparatus.
Figure 2:
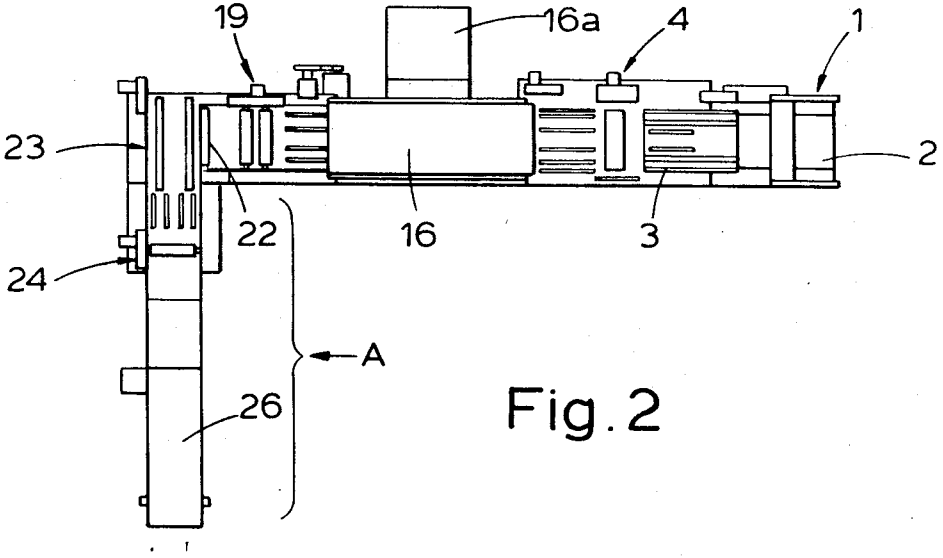
FIG. 2 is a plan view of the apparatus shown in FIG. 1.

Referring to the drawings, FIGS. 1 and 2 show apparatus comprising a sheet feeder 1 which contains a stack of pre-printed sheets 2. Each of these sheets is pre-printed with a plurality of rows of matchbox blanks. The sheet feeder 1 is of the non-stop type, and can be reloaded without stopping the machine. The sheet feeder 1 feeds the sheets 2 one-by-one onto a conveyor 3, which feeds the sheets to a gravure printing machine 4. The conveyor 3 is a steel belt infeed and sidelay. The sheets 2 are fed into the gravure printing machine 4 by dogs (not shown) carried on the steel belts. Register is achieved by a manually-controlled differential (not shown) which advances or retards the sheets 2. The conveyor 3 can be hinged away to allow access to the gravure printing machine 4 for cleaning.

Figure 3:
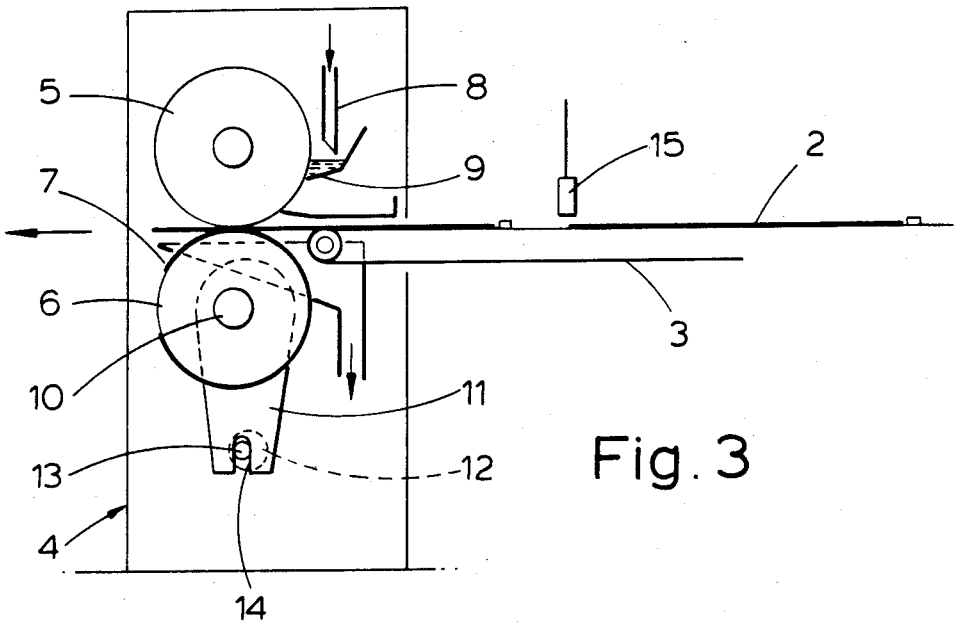
FIG. 3 is an enlarged schematic side elevation of the gravure printing machine which forms part of the apparatus of FIGS. 1 and 2.
Figure 6:
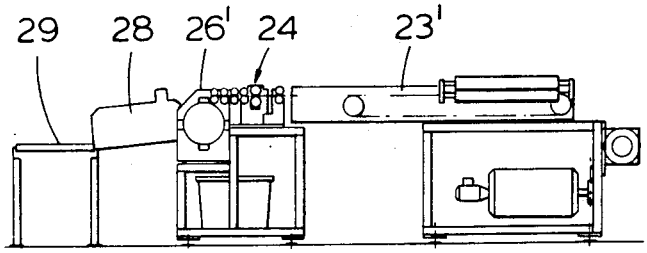
FIG. 6 is an enlarged schematic end elevation of part of the second form of apparatus.
Figure 7:
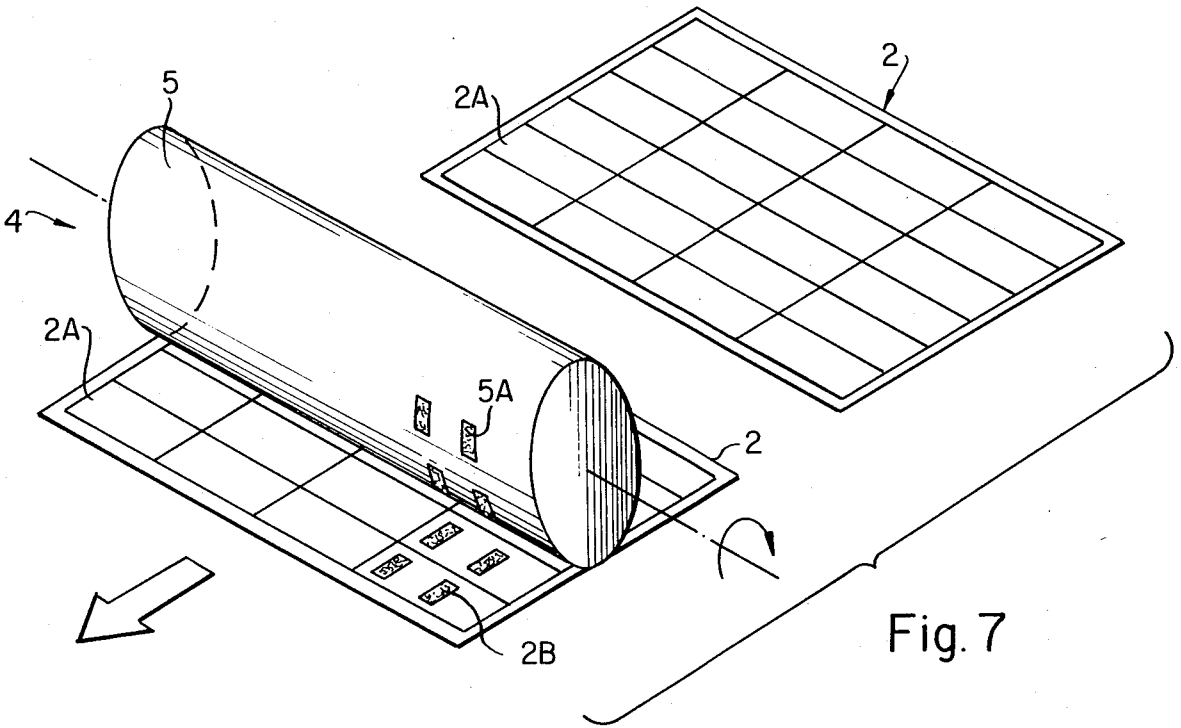
FIG. 7 is a schematic perspective view of the engraving roller of the gravure printing machine.

The gravure printing machine 4 (see FIG. 3) has an upper engraving roller 5, and a lower pressure roller 6. A blanket 7 made of self-adhesive sheet material is fixed to, and passes around 5/6 of the circumference of, the pressure roller 6. If the blanket 7 extended right round the pressure roller 6, it would contact the engraving roller 5 whenever a sheet 2 was not present in the nip between the two rollers. This would result in the transfer of striking compound material to the blanket 7 from the engraving roller 5, resulting in a dirty blanket; and, as printing proceeds, the striking compound material would gradually cover the entire blanket. Obviously, this is undesirable, as it deposits striking compound material all over the sheets 2, and not merely in the required places. The blanket 7 is also slightly narrower than the sheets 2 to be printed, this preventing build-up of striking compound material at the edges of the sheets. FIG. 7 shows a sheet 2 having rows of preprinted matchbox blanks 2A. Surface pattern 5A of engraving roller 5 in printing machine 4 imprints a printed pattern 2B on sheet 2 as shown fed to printing machine 4.

Three supply nozzles 8 are provided for supplying striking compound material to the outer surface of the engraving roller 5. These nozzles 8 are supplied with the striking compound material via a peristaltic pump (not shown). Unused compound returns to a reservoir (not shown) under gravity. A doctor blade 9 is provided for distributing the striking compound material evenly over the surface of the engraving roller 5. The two rollers 5 and 6 are geared together for rotation in opposite directions, and the two rollers are positioned to define an accurate nip. The width of this nip can be adjusted to conform with the thickness of the sheets 2.

The pressure roller 6 is mounted, at each end, in an eccentric bearing 10. Each bearing 10 is mounted on an arm 11 which can be moved up and down via a disc 12. The discs 12 are driven by a half-revolution clutch (not shown). Each disc 12 carries an eccentric cam roller 13 which engages in a slot 14 formed in the end of the respective arm 11. Thus, each time the half-revolution clutch is operated, the discs 12 move through 180°, so that the cam rollers 13 moves from side to side and the bearings 10 move up and down. The half-revolution clutch is controlled by a sheet sensor 15. The arrangement is such that, whenever a sheet 2 does not arrive underneath the sensor 15 at the correct time, the half-revolution clutch is operated to move the pressure roller 6 downwards. Thus, when a sheet 2 is not passing through the continuously rotating rollers 5 and 6, the rollers are spaced apart further than the pre-set nip, so that no compressive forces are applied. In other words, the movable mounting of the pressure roller 6, and the sensor 15, ensure that the pressure roller is moved away from the engraving roller 5 in case of sheet mis-feed.

As the sheets 2 leave the gravure printing machine 4, they are fed to a radio frequency drier 16 on a transfer unit 17. The transfer unit 17 includes a conveyor belt, and can be hinged away to allow access to the gravure printing machine 4 for cleaning. The sheets 2 are carried through the drier 16 on a perforated PTFE-coated glass fibre belt (not shown). The interior of the drier 16 is subjected to a partial vacuum, so that the belt acts as a vacuum belt, and so holds the sheets 2 firmly in position as they move through the drier.

The drier 16 has drying electrodes (not shown) mounted beneath the transportation belt, and an RF power supply **16*a*, which is a floor standing unit positioned immediately behind the machine. The drier 16 also includes a fan (not shown) for the vacuum conveyor belt, and extraction fans (not shown) for removing moisture are also supplied. The whole unit is fully interlocked for safety-in the event of the top section of the drying chamber being raised for access, the drier 16** immediately cuts out.

When the sheets 2 leave the drier 16, they pass, via a sidelay 18 to a slitter/creaser 19. The sidelay 18 is a belt unit which receives the sheets 2 from the drier 16, and sidelays them before entry into the slitter/creaser 19. The slitter/creaser 19 has a creasing station 20 and a slitting station 21. The creasing station 20 includes removable upper and lower rollers **20*a* and 20*b* which have the creasing form machined on them. Since all the creases are transverse, the rollers 20*a* and 20*b* are of simple design, and are easily fabricated. Nicked slitting knives 21*a* and 21*b* are used in the slitting station 21. Here again, this is a simple arrangement. The use of nicked knives 21*a* and 21*b* ensures that the longitudinal strips of matchbox blanks formed in the station 21 are held together as the sheets 2** pass further along the apparatus.

The creased, slit and nicked sheets 2 then pass onto a throw roller 22, which throws the sheets onto a belt unit 23 which runs transversely to the previous direction of transport. This belt unit 23, which comprises a set of toothed belts and a set of tapes (not shown), sidelays the sheets 2, and feeds them to a second slitting machine 24 which slits the blanks transversely. The timing adjustment of the toothed belts of the belt unit 23 is achieved using a differential (not shown). The second slitting machine 24 is similar to the unit 19, but has no creasing rollers. Its slitting knives 24*a* and 24*b* are, however, plain (that is to say they do not have nicks).

The transversely slit sheets 2 then pass to a unit 25 which includes a nick breaker (not shown) and a series of independently-driven throw rollers. The nick breaker breaks the individual blanks (skillets), and the throw rollers shingle the skillets onto a receptacle 26. The receptacle 26 is a slow moving wide band receptacle, which will receive up to ten shingled rows of skillets, which are then collected by hand.

Figure 4:
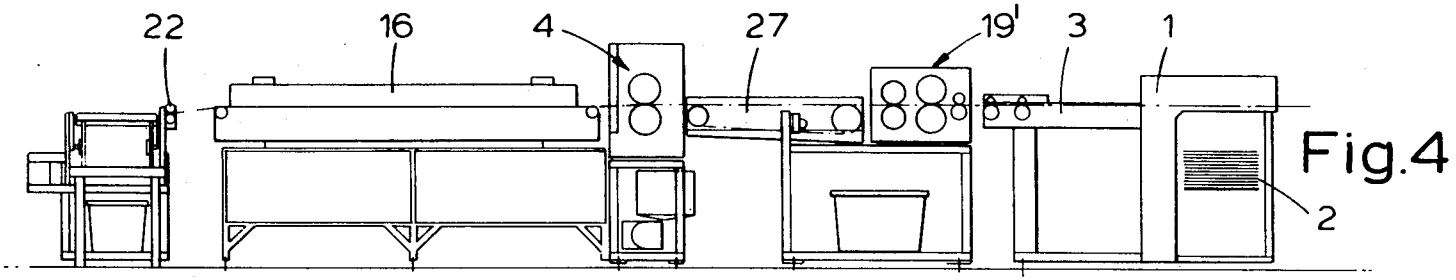
FIG. 4 is a schematic side elevation of the second form of apparatus.
Figure 5:
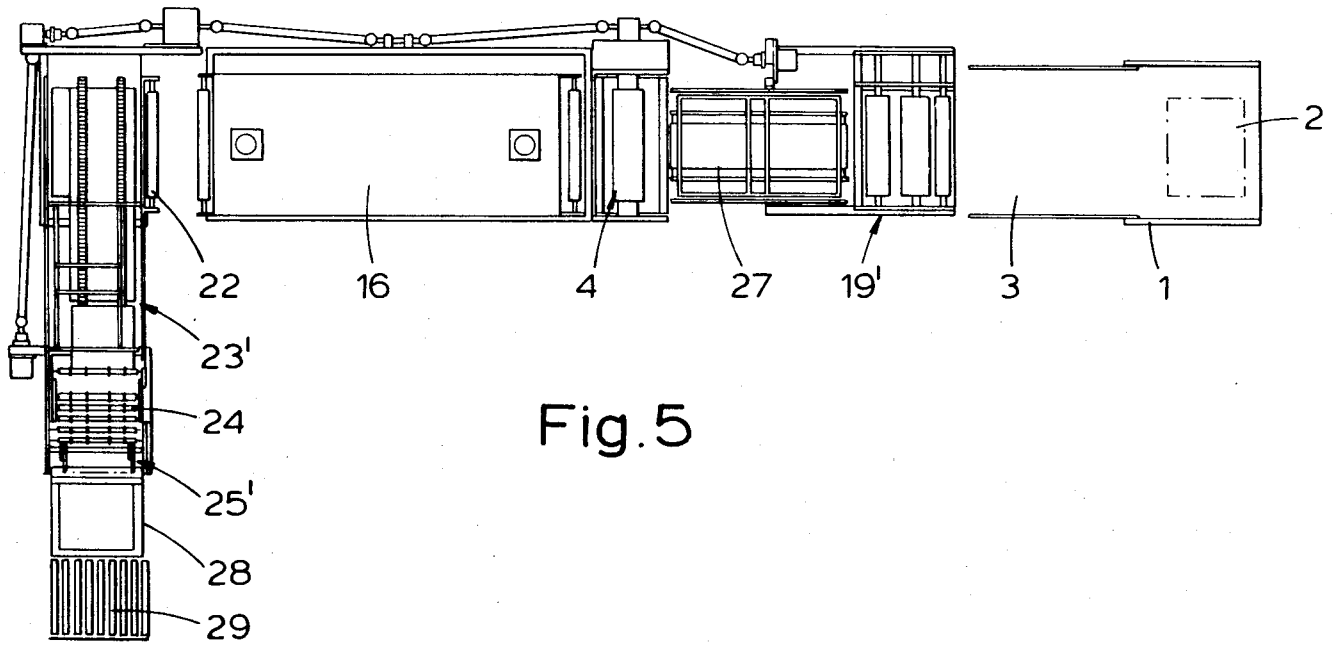
FIG. 5 is a plan view of the apparatus shown in FIG. 4.

FIGS. 4 and 5 show a second form of apparatus for forming matchbox blanks from pre-printed sheets. This second form of apparatus is very similar to the first form of apparatus, and so like reference numerals are used for like parts. As with the first form of apparatus, the second form of apparatus has a sheet feeder 1 which feeds pre-printed sheets 2 to a gravure printing machine 4. In this case, however, the sheets 2 are fed to the gravure printing machine 4 via a conveyor 3', a slitter/creaser unit 19' and a register/transfer conveyor 27. The slitter/creaser unit 19' is equivalent to the unit 19 of the first form of apparatus, and slits the sheets 2 longitudinally before they reach the gravure printing machine 4.

When the sheets 2 leave the gravure printing machine 4, they are passed to a radio frequency drier 16. On leaving the drier 16, the sheets 2 pass onto a throw roller 22, which throws them onto a belt unit 23' which runs transversely to the previous direction of transport. The sheets 2 then pass to a second slitting machine 24, which slits them transversely, and cuts off the end trims. The individual matchbox blanks (skillets) are then passed to a gripper drum receptacle 26', which delivers them to a take-off unit 28.

The sheet feeder 1, the gravure printing machine 4, the radio frequency drier 16, the throw roller 22, and the second slitting machine 24 are all identical to the equivalent parts of the first form of apparatus, and so these items will not be described further. The remaining parts of the second form of apparatus are slightly different from the equivalent parts of the first form of apparatus, and these will now be described.

The conveyor 3 includes tapes (not shown) which carry the sheets 2 from the feeder 1 up to front lays (not shown). Here, they are sidelayed before being accelerated into the slitter/creaser unit 19'. This conveyor 3' is intended to reproduce, as nearly as possible, the sidelay conditions which existed on the litho printing machine which produced the pre-printed sheets 2.

The slitter/creaser unit 19' creases the sheets 2 transversely, and slits the slits and the sheets in the longitudinal direction. A narrow portion at each end of each sheet 2 is left unslit, so that the sheets can be held together as they are moved into the gravure printing machine 4. The sheets 2 are trimmed to width in the unit 19', and this enables the matchbox striking compound to be "printed" in a good lateral register with the pre-printed matchbox blanks. As with the slitter/creaser unit 19 of FIGS. 1 and 2, the unit 19' has a creasing station 20' and a slitting station 21'. The creasing station 20' includes removable upper and lower rollers 20*a'* and 20*b'*. The rollers 20*a'* and 20*b'* again have simple circular creasing forms machined thereon. The rollers 20*a'* and 20*b'* can be adjusted for creasing depth, and are easily removed to facilitate changing the layout of the matchbox blanks.

As mentioned above, the slitting station 21' is designed to leave a continuous narrow portion (trim) at the front and rear ends of each sheet 2. These trims are taken off by the second slitting machine 24. Until then, however, they serve to hold the sheets 2 together. The slitting station 21' includes slitting knives 21*a'* and 21*b'*. Because the trims hold the sheets 2 together, there is no need for the knives 21*a'* and 21*b'* to be knicked. The knives 21*a'* and 21*b'* are detachably mounted, so that they can be easily removed for sharpening. The knives 21*a'* and 21*b'* are positioned transversely with respect to the direction of movement of the sheets 2 through the unit 19' using spacers (not shown). The spacers can be changed to position the knives 21*a'* and 21*b'* in line with the layout of the matchbox blanks, so that the slitting knives can be repositioned for different layouts. Moreover, the slitting knives 21*a'* and 21*b'* can be adjusted in an angular sense. This permits the unit 19' to operate is synchronism with the sheet feeder 1.

The register/transfer conveyor 27 includes blocks (not shown) which push the sheets 2 forwards between side guides (not shown). The position of the blocks can be adjusted with respect to the engraving to maintain good register. The whole conveyor 27 can be hinged away from the gravure printing machine 4 to allow easy access for cleaning.

The belt unit 23' is identical to the belt unit 23 of FIGS. 1 and 2, but includes an additional belt (not shown) which is placed at a small angle to the other belts. The additional belt is used to sidelay the sheets 2 as they are carried forwards on the main belts.

The gripper drum receptacle 26' includes a series of rollers (not shown) and a gripper drum (not shown). The individual skillets are carried by the rollers into the gripper drum. This unit has a series of discs with grippers adjustably mounted thereon. These discs can be positioned across the machine, and the number of grippers mounted thereon can be varied.

The grippers deliver the skillets into trays (not shown) at the take-off unit 28. Each tray contains a counted batch of skillets. Full trays can be removed at a take-off table 29, and replaced by empty ones as the machine is running.

It will be apparent that each of the forms of apparatus described above converts pre-printed sheets to finished matchbox skillets, by applying patterned striking compound stripes. Moreover, each apparatus requires only one operator, plus take-off personnel, and can produce the full range of standard matchbox skillets with the minimum of downtime and change parts. It can also handle book match covers.

It will be apparent that a number of changes could be made to the apparatus described above. In particular, a hot melt could be applied to the sheets 2 instead of the striking compound. In this case, sand would be added to the tacky hot melt printed areas to produce sandpaper striking panels, and there would be no need for a radio frequency drier.

We claim:

1. Apparatus for forming matchbox skillets from pre-printed sheets, each sheet having a plurality of rows of matchbox blanks printed thereon, the apparatus comprising:

(a) a sheet feeder for storing pre-printed sheets and removing the sheets one-by-one, (b) conveyor means for conveying the sheets from the sheet feeder to a gravure printing machine along a path, (c) means for longitudinally and transversely cutting the matchbox blanks from the sheets to form matchbox skillets, and (d) a gravure printing machine for applying coating material to pre-determined areas of the sheets as they pass therethrough, (i) the gravure printing machine including an upper engraving roller, a lower pressure roller, and means for feeding pre-printed sheets between the two rollers so that said predetermined areas are in register with complementary areas on the matchbox blanks of the pre-printed sheets, (ii) the surface of the engraving roller including a plurality of axially-extending rows of patterned areas, each of which corresponds in shape to that of the striking panel of a box of matches, there being as many rows of patterned areas as there are rows of pre-printed matchbox blanks on each of the sheets fed to the printing machine.

2. A gravure printing machine according to claim 1, further comprising means for supplying coating material to the surface of the engraving roller, means for distributing the coating material evenly over the surface of the engraving roller, and means for adjusting the nip between the two rollers.

3. A gravure printing machine according to claim 2, wherein the supply means is constituted by a pump and at least one nozzle.

4. A gravure printing machine according to claim 2, wherein the distribution means is constituted by a doctor blade.

5. A gravure printing machine according to claim 1, wherein the pressure roller includes a blanket which passes around a predetermined portion of the circumference of the pressure roller.

6. A gravure printing machine according to claim 5, wherein the blanket passes around 300° of the circumference of the pressure roller.

7. A gravure printing machine according to claim 5 wherein the blanket is made of self-adhesive sheet material about 1 millimeter thick.

8. A gravure printing machine according to claim 1, further comprising operator means for moving the rollers apart.

9. A gravure printing machine according to claim 8, wherein the operator means is controlled by sensing means arranged to sense the sheets as they are fed toward the rollers.

10. A gravure printing machine according to claim 9, wherein the operator means is effective to move the pressure roller toward, and away from the engraving roller.

11. A gravure printing machine according to claim 10, wherein the pressure roller is mounted on eccentric bearings, each of which bearings is moved up and down by a respective arm, each of said arms being moved, in turn, by a half-revolution clutch which rotates a respective eccentric disc carrying a cam roller which engages in a slot formed in the end of the respective arm.

12. A gravure printing machine according to claim 1, wherein the two rollers are geared together for rotation in opposite senses.

13. Apparatus according to claim 1, further comprising a drier for drying the coating material printed on said predetermined areas, the drier being positioned along said path downstream of the gravure printing machine.

14. Apparatus according to claim 13, wherein the drier is a radio frequency drier.

15. Apparatus according to claim 14, wherein first and second cutting stations are disposed along said path and comprise the means for cutting up the sheets, the first cutting station cutting the sheets longitudinally, and the second cutting station cutting the sheets transversely.

16. Apparatus as claimed in claim 15, wherein both cutting stations are positioned downstream of the drier.

17. Apparatus according to claim 15, wherein the first cutting station is positioned along said path upstream of the gravure printing machine, and the second cutting station is positioned along said path downstream of the drier with the conveyor means effective to convey the cut sheets along said path.

18. Apparatus according to claim 15, wherein the first cutting station forms part of a slitter/creaser unit with the conveyor means effective to convey the cut sheets along said path, and includes means for forming transverse creases on the matchbox blanks.

19. Apparatus for forming matchbox skillets from pre-printed sheets, each sheet having a plurality of rows of matchbox blanks printed thereon, the apparatus comprising:

(a) a sheet feeder for storing pre-printed sheets and removing the sheets one-by-one, (b) a conveyor for conveying the sheets from the sheet feeder to a gravure printing machine, (c) means for longitudinally and transversely cutting the matchbox blanks from the sheets to form matchbox skillets, and (d) a gravure printing machine for applying coating material to predetermined areas of the sheets as they pass therethrough, (i) the gravure printing machine including an upper engraving roller, a lower pressure roller, and means for feeding pre-printed sheets between the two rollers so that said predetermined areas are in register with complementary areas on the matchbox blanks of the pre-printed sheets, (ii) the pressure roller including a blanket which passes around a predetermined portion of the circumference of the pressure roller.

20. A gravure printing machine comprising:

(a) means for applying coating material to predetermined areas of pre-printed sheets, each sheet having a plurality of rows of matchbox blanks printed thereon, (i) said applying means including an upper engraving roller, a lower pressure roller, and means for feeding said pre-printed sheets between the two rollers so that said predetermined areas are in register with complementary areas on the matchbox blanks of the pre-printed sheets, (ii) the surface of the engraving roller including means defining a plurality of axially-extending rows of patterned areas, each of which corresponds in shape to that of the striking panel of a box of matches, (iii) said rows defining means including as many rows of patterned areas as there are rows of pre-printed matchbox blanks on each of the sheets fed to the printing machine, (iv) the pressure roller being mounted on eccentric bearings, each of which bearings is moved up and down by a respective arm, (v) each of said arms being moved, in turn, by a half-revolution clutch which rotates a respective eccentric disc carrying a cam roller which engages in a slot formed in the end of the respective arm, (b) operator means for moving the pressure roller toward and away from the engraving roller, and (c) sensing means for controlling the operator means and being arranged to sense the sheets as they are fed toward the rollers.

* * * * *